US007380489B2

(12) United States Patent
Jeon

(10) Patent No.: US 7,380,489 B2
(45) Date of Patent: Jun. 3, 2008

(54) HYDRAULIC CIRCUIT FOR OPTION DEVICE OF HEAVY CONSTRUCTION EQUIPMENT

(75) Inventor: Man Suk Jeon, Kyungsangnam-do (KR)

(73) Assignee: LVO Construction Equipment Holding AB, Eskilstuna (SE)

( * ) Notice: Subject to any disclaimer, the term of this patent is extended or adjusted under 35 U.S.C. 154(b) by 90 days.

(21) Appl. No.: 11/403,710

(22) Filed: Apr. 13, 2006

(65) Prior Publication Data

US 2006/0288862 A1 Dec. 28, 2006

(30) Foreign Application Priority Data

Jun. 27, 2005 (KR) ..... 10-2005-0055458

(51) Int. Cl.
*F15B 11/042* (2006.01)
*F15B 11/05* (2006.01)

(52) U.S. Cl. ..... 91/446

(58) Field of Classification Search ..... 91/445, 91/446, 448

See application file for complete search history.

(56) References Cited

U.S. PATENT DOCUMENTS 6,973,866 B2 * 12/2005 Lee ..... 91/448

* cited by examiner

*Primary Examiner*—F. Daniel Lopez
(74) *Attorney, Agent, or Firm*—Ladas & Parry LLP

(57) ABSTRACT

Disclosed is a hydraulic circuit for an option device of heavy construction equipment which can facilitate manipulation of the option device such as a breaker and optionally control a flow rate by supplying hydraulic fluid from a hydraulic pump to the option device at a constant flow rate, regardless of the size of load produced on the option device. The hydraulic circuit includes a variable displacement hydraulic pump, an option device connected to the hydraulic pump, a first spool, installed in a flow path between the hydraulic pump and the option device, for being shifted in response to a pilot signal pressure applied from an outside to control a flow rate applied from the hydraulic pump to the option device, a poppet, operatively installed in a flow path between the hydraulic pump and the first spool, for supplying hydraulic fluid to the option device when the first spool is shifted, a piston resiliently urged in a back pressure chamber of the poppet, and a second spool for being shifted by a pressure difference between pressures of the hydraulic fluid before and after the hydraulic fluid passes through the first spool, and controlling the flow rate applied to the back pressure chamber of the poppet via a through-path communicating with the back pressure chamber when the second spool is shifted.

4 Claims, 4 Drawing Sheets

HYDRAULIC CIRCUIT FOR OPTION DEVICE OF HEAVY CONSTRUCTION EQUIPMENT

CROSS-REFERENCE TO RELATED APPLICATION

This application is based on and claims priority from Korean Patent Application No. 10-2005-0055458, filed on Jun. 27, 2005, the disclosure of which is incorporated herein in its entirety by reference.

BACKGROUND OF THE INVENTION

1. Field of the Invention

The present invention relates to a hydraulic circuit for an option device of heavy construction equipment which can supply hydraulic fluid from a hydraulic pump to the option device such as a breaker at a constant flow rate, regardless of the size of load produced on the option device, in the case where the option device is mounted on the heavy construction equipment.

More particularly, the present invention relates to a hydraulic circuit for an option device of heavy construction equipment which can facilitate manipulation of the option device such as a breaker and optionally control a flow rate required according to the specifications of the option device by supplying hydraulic fluid from a hydraulic pump to the option device at a constant flow rate, regardless of the size of load produced on the option device.

2. Description of the Prior Art

As shown in FIG. 1, a conventional flow control valve includes a variable displacement hydraulic pump 1, a supply line 8 communicating with the hydraulic pump 1, an option device 2 (e.g., a working device such as a breaker or hammer, a shear, a tilt, and others) connected to the hydraulic pump 1 via an actuator port 7 communicating with the supply line 8, a poppet 5, installed in a parallel path 6, for communicating with the supply line 8 and controlling hydraulic fluid to be supplied to the actuator port 7, and a spool 3, installed in a path between the hydraulic pump 1 and the option device 2, for being shifted in response to a pilot signal applied from an outside to control the flow rate and flow direction of the hydraulic fluid that is supplied to the option device 2.

In the drawing, reference numerals 4 and 4*a* denote a relief valve.

The hydraulic fluid discharged from the hydraulic pump 1 flows through the supply line 8 to push the poppet 5 upward as shown in the drawing, and is maintained in the parallel path 6. If a pilot signal pressure Pb is applied to the left end of the spool 3 from the outside, the spool 3 is shifted rightward as shown in the drawing. The hydraulic fluid maintained in the parallel path 6 is then supplied to the option device 2 via the actuator port 7 by the spool 3.

The option device 2 has different specifications according to its manufacturer. That is, if various kinds of option devices having different flow rates and pressures are used in the equipment, different flow rates are required for the respective option devices. However, since a constant flow rate is applied from the hydraulic pump 1 to the various kinds of option devices, it is impossible to control the flow rates to the option devices, respectively.

As an operating speed of the option device 2 is varied depending upon the load fluctuation occurring in the option device 2, even a skilled driver cannot effectively manipulate the option device 2, and this causes the workability of expensive heavy construction equipment to be degraded.

SUMMARY OF THE INVENTION

Accordingly, the present invention has been made to solve the above-mentioned problems occurring in the prior art, and an object of the present invention is to provide a hydraulic circuit for an option device of heavy construction equipment which can facilitate manipulation of the option device such as a breaker and optionally control a flow rate required according to the specifications of various kinds of option devices by supplying hydraulic fluid from a hydraulic pump to the option device at a constant flow rate, regardless of the size of load produced on the option device, in the case where the option device is mounted on the heavy construction equipment.

Another object of the present invention is to provide a hydraulic circuit for an option device of heavy construction equipment which enables even an unskilled driver to easily manipulate various kinds of option devices and thus provides convenience in manipulation to the driver.

In order to accomplish this object, there is provided a hydraulic circuit for an option device of heavy construction equipment, according to the present invention, which includes a variable displacement hydraulic pump, an option device connected to the hydraulic pump, a first spool, installed in a flow path between the hydraulic pump and the option device, for being shifted in response to a pilot signal pressure applied from an outside to control a flow rate applied from the hydraulic pump to the option device, a poppet, operatively installed in a flow path between the hydraulic pump and the first spool, for supplying hydraulic fluid from the hydraulic pump to the option device when the first spool is shifted, a piston resiliently urged in a back pressure chamber of the poppet, and a second spool for being shifted by a pressure difference between pressures of the hydraulic fluid before and after the hydraulic fluid passes through the first spool, and controlling the flow rate applied from the hydraulic pump to the back pressure chamber of the poppet via a through-path communicating with the back pressure chamber when the second spool is shifted, wherein if the hydraulic fluid is supplied from the hydraulic pump to the option device, a pressure loss produced between signal pressures that shift the second spool is maintained constant by a repeated shifting of the second spool to control the hydraulic fluid to be constantly supplied to the option device.

According to another aspect of the present invention, there is provided a hydraulic circuit for an option device of heavy construction equipment, which includes a variable displacement hydraulic pump, an option device connected to the hydraulic pump, a first spool having an orifice, installed in a flow path between the hydraulic pump and the option device, for controlling hydraulic fluid to be discharged from the hydraulic pump and supplied to the option device, and a variable orifice for being shifted in response to a pilot signal pressure applied from an outside to variably control the hydraulic fluid supplied from the hydraulic pump to the option device, a poppet, operatively installed in a flow path between the hydraulic pump and the first spool, for supplying the hydraulic fluid from the hydraulic pump to the option device from the hydraulic pump when the first spool is shifted, a piston resiliently urged in a back pressure chamber of the poppet, and a second spool for being shifted by a pressure difference between pressures of the hydraulic fluid before and after the hydraulic fluid passes through the first spool, and controlling the flow rate applied from the hydraulic pump to the back pressure chamber of the poppet via a through-path communicating with the back pressure chamber when the second spool is shifted, wherein if the hydraulic fluid is supplied from the hydraulic pump to the option device, a pressure loss produced between signal pressures that shift the second spool is maintained constant by a repeated shifting of the second spool to control the hydraulic fluid to be constantly supplied to the option device.

The hydraulic circuit may further include an electric selection switch for applying the pilot signal pressure to a flow rate display unit required for the selected option device, corresponding to the flow rate being supplied to the selected option device, if diverse option devices are used as means for applying the pilot signal pressure to shift the first spool.

The hydraulic circuit may further include a first orifice, formed on the piston, for controlling the hydraulic fluid discharged from the hydraulic pump and supplied to the back pressure chamber of the poppet when the second spool is shifted, a second orifice, installed in a flow path between the second spool and the back pressure chamber of the piston, for controlling the hydraulic fluid supplied from the hydraulic pump to the back pressure chamber of the piston when the second spool is shifted, and a third orifice, having an inlet that communicates with a flow path between the first spool and the poppet and an outlet installed in a path that communicates with the second spool, for controlling the hydraulic fluid that is discharged from the hydraulic pump and shifts the second spool.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 1:
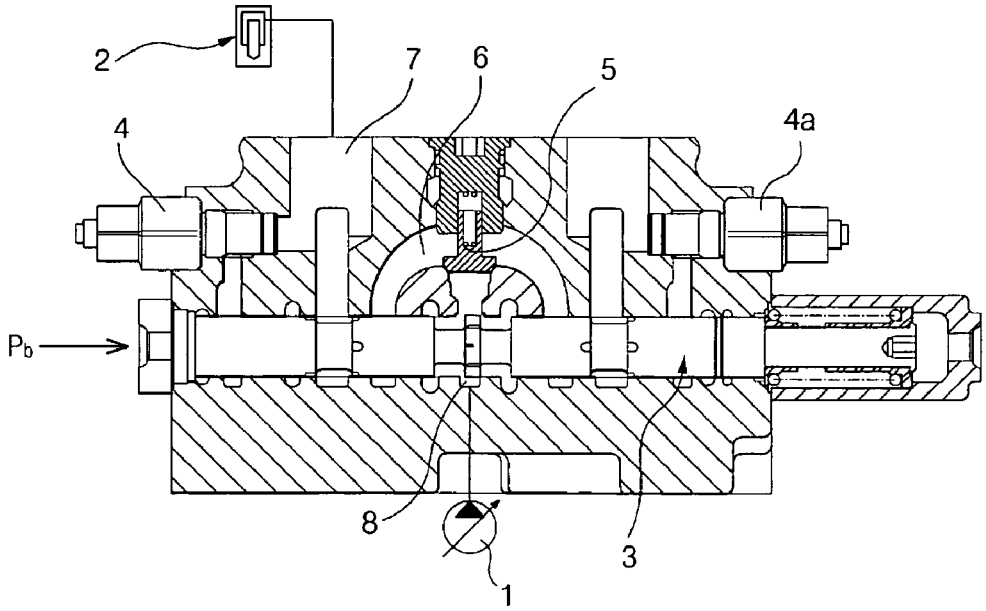
Fig. 1 Prior Art
FIG. 1 is a cross-sectional view of a conventional flow control valve.
Figure 2:
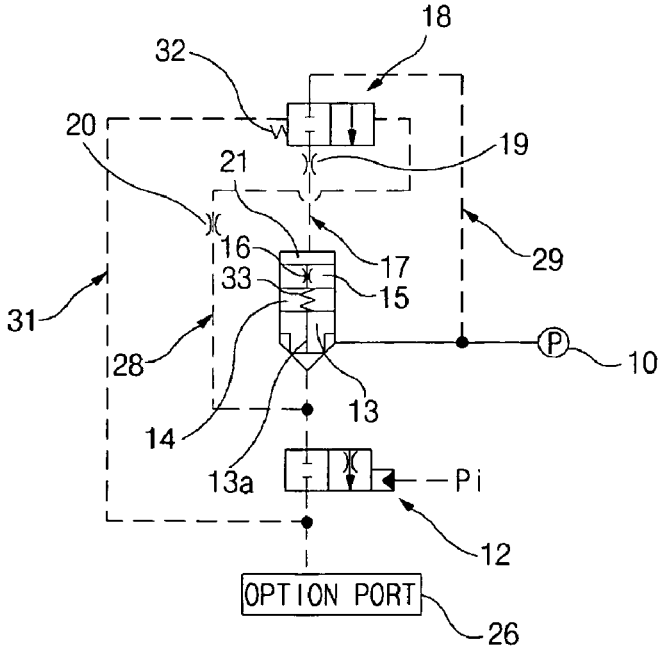
FIG. 2 is a circuit diagram illustrating a hydraulic circuit for an option device of heavy construction equipment according to the present invention.
Figure 3:
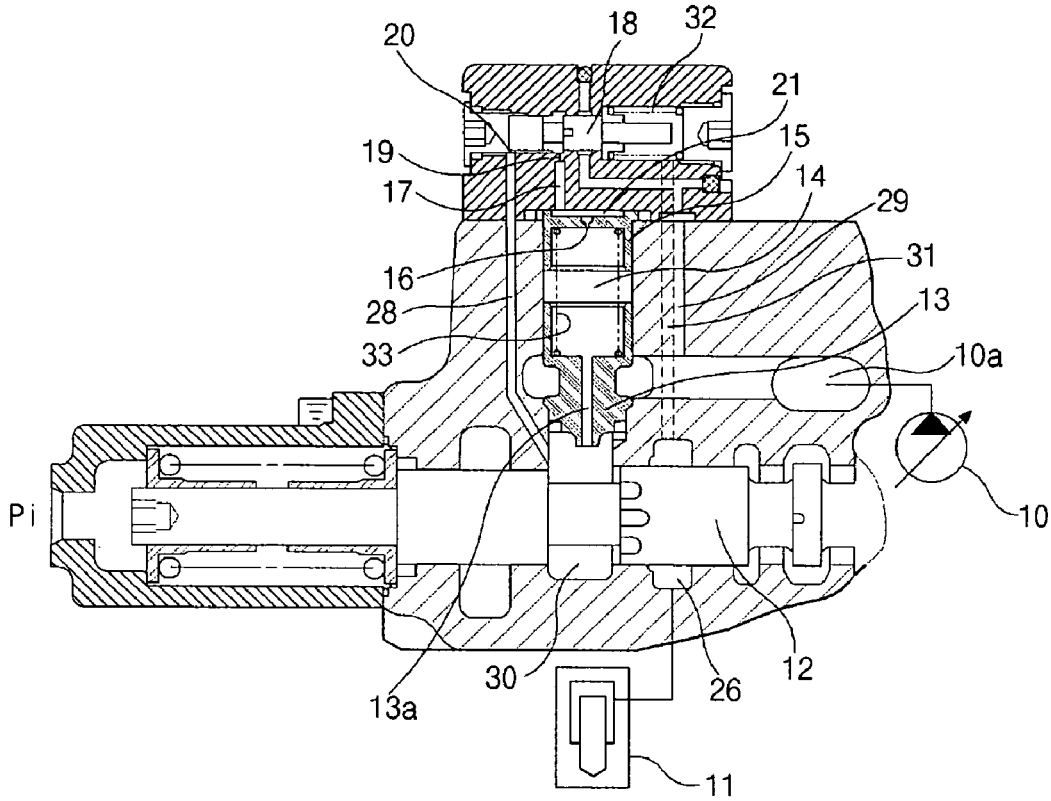
FIG. 3 is a cross-sectional view of a flow control valve corresponding to a hydraulic circuit according to the present invention.

As shown in FIGS. 2 and 3, a hydraulic circuit for an option device of heavy construction equipment according to the present invention includes a variable displacement hydraulic pump 10, an option device 11 (e.g., a working device such as a breaker) connected to the hydraulic pump 10, a first spool 12, installed in a flow path between the hydraulic pump 10 and the option device 11, for being shifted in response to a pilot signal pressure applied from an outside to control a flow rate applied to the option device 11 via an option port 26, a poppet 13, operatively installed in a flow path between the hydraulic pump 10 and the first spool 12, for supplying a hydraulic fluid from the hydraulic pump to the option device 11 when the first spool 12 is shifted, a piston 15 resiliently urged in a back pressure chamber 14 of the poppet 13, and a second spool 18 for being shifted by a pressure difference between pressures of the hydraulic fluid before and after it passes through the first spool 12, and controlling the flow rate supplied from the hydraulic pump 10 to the back pressure chamber 14 of the poppet 13 via a through-path 17 that communicates with the back pressure chamber 14 when the second spool 18 is shifted.

The hydraulic circuit also includes a first orifice 16, formed in the piston 15, for controlling the hydraulic fluid supplied from the hydraulic pump 10 to the back pressure chamber 14 of the poppet 13 when the second spool 18 is shifted, a second orifice 19, installed in a flow path 27 between the second spool 18 and the back pressure chamber 21 of the piston 15, for controlling the hydraulic fluid supplied from the hydraulic pump 10 to the back pressure chamber 21 of the piston 15 when the second spool 18 is shifted, and a third orifice 20, having an inlet that communicates with a flow path between the first spool and the poppet and an outlet installed in a path that communicates with the second spool, for controlling the hydraulic fluid that is discharged from the hydraulic pump to shift the second spool.

In the drawings, the reference numeral 29 indicates a pilot path which communicates with a supply line 10*a* of the variable displacement hydraulic pump 10 and through which a signal pressure for shifting the second spool 18 passes.

The hydraulic circuit for the option device of the heavy construction equipment according to an embodiment of the present invention will be described in detail with reference to the accompanying drawings.

As shown in FIGS. 2 and 3, the hydraulic fluid discharged from the variable displacement hydraulic pump 10 is supplied to the supply line 10*a* and the pilot path 29 that communicates with the supply line 10*a*. The poppet 13 is lifted up, as shown in the drawing, by the hydraulic fluid supplied to the supply line 10*a*. In this case, the hydraulic fluid supplied to the back pressure chamber of the poppet 13 flows into a chamber 30 via an orifice 13*a* of the poppet 13, so that the poppet 13 is moved upwardly to contact the piston 15 (at this time, a resilient member 33 is compressed). Accordingly, the hydraulic fluid of the supply line 10*a* flows into the chamber 30.

If a pilot signal pressure Pi is applied to the left end of the first spool 12 from the outside, the first spool 12 is shifted to the right as shown in FIG. 3. The hydraulic fluid discharged from the variable displacement hydraulic pump 10 and supplied to the chamber 30 is supplied to the option port 26, and is then supplied to the option device 11 to drive the option device 11.

In the case where the option port 26 communicates with the chamber 30 by the shift of the first spool 12 to supply the hydraulic fluid discharged from the hydraulic pump 10 to the option device 11, there exists a pressure difference between the pressure of the hydraulic fluid before it passes through the second spool 18 and the pressure of the hydraulic fluid after it passes through the second spool 18 (at this time, as the flow rate is increased, a pressure loss is also increased).

The pressure increased by the shift of the first spool 12 is supplied to the left end of the second spool 18 along a path 28 that communicates with the chamber 30. Specifically, if the hydraulic fluid is supplied to the second spool 18 via the third orifice 20 formed at the end of the flow path 28, the second spool 18 is shifted to the right as shown in FIG. 3. In this case, on the assumption that an area of the hydraulic portion of the second spool 18 is A1, the force of shifting the second spool 18 to the right becomes A1×P1.

The pressure of the option port 26 is applied to the right end of the second spool 18 via the pilot path 31, so that the second spool 18 is shifted to the left. In this case, on the assumption that the area of the hydraulic portion of the second spool 18 is A2, the force of shifting the second spool 18 in the left direction becomes (A1×P1)+F1 (resilient force of the resilient member 32).

Specifically, the condition of maintaining the second spool 18 in its initial state as shown in FIG. 3 is given as (A1×P1)<(A2×P2)+F1, and the condition of shifting the second spool 18 to the right is given as (A1×P1)>(A2×P2)+F1.

Specifically, in the case of shifting the second spool 18 to the right as shown in the drawing, as the hydraulic fluid is supplied to the left end of the second spool 18 via the flow path 28, the second spool 18 is shifted to the right as shown in the drawing. In this case, the hydraulic fluid supplied to the pilot path 29 that communicates with the supply line 10*a* passes through the second spool 18 and the through-path 17, and is then supplied to the back pressure 21 of the piston 15, thereby moving the piston 15 downwardly as shown in the drawing. Simultaneously, the poppet 13 resiliently urged by the resilient member 33 is moved downward.

If the poppet 13 is moved downward, the flow path between the supply line 10*a* and the chamber 30 is interrupted by the poppet 13. As the pressure in the flow path 28 is decreased, the second spool 18 is moved to the left as shown in the drawing. That is, an equation (A1×P1)<(A2×P2)+F1 is valid.

If the second spool 18 is moved to the left as shown in the drawing, the supply of the pressure from the pilot path 29 to the through-path 17 is interrupted. Therefore, as the poppet 13 is moved upward as shown in the drawing, the hydraulic fluid discharged from the hydraulic pump 10 is supplied to the second spool 18 via the chamber 30 and the flow path 28. Thus, an equation (A1×P1)>(A2×P2)+F1 is valid. Accordingly, the second spool 18 is shifted to the right as shown in the drawing.

Figure 4:
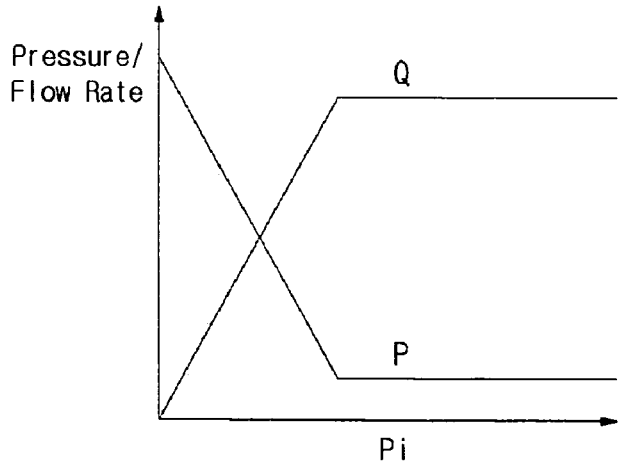
FIG. 4 is a graph illustrating a relation between a discharge flow rate and a pump pressure in accordance with a pilot signal pressure according to the present invention.
Figure 5:
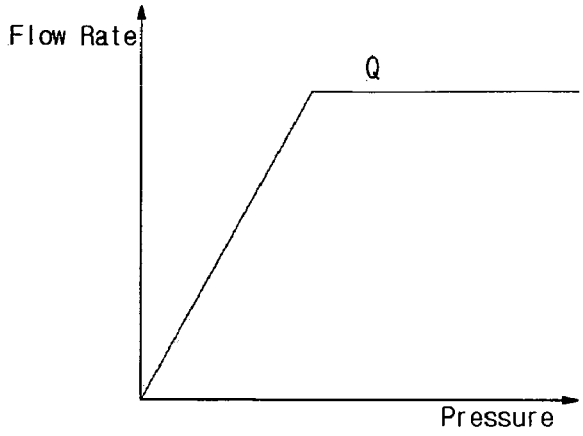
FIG. 5 is a graph illustrating a relation between pressure and a discharge flow rate according to the present invention.

As shown in FIGS. 4 and 5, the pressure loss produced between the signal pressures for shifting the second spool 18 is maintained constant by the repeated shift of the second spool 18.

That is, the flow rate Q supplied to the option device 11 is $Q=Cd\times A\times \Delta P$ (where, Q is a flow rate, Cd is a flow coefficient, A (an opening area of the spool) is a constant, and ΔP (a pressure difference between the flow path 27 and the flow path 28) is a constant.

Figure 6:
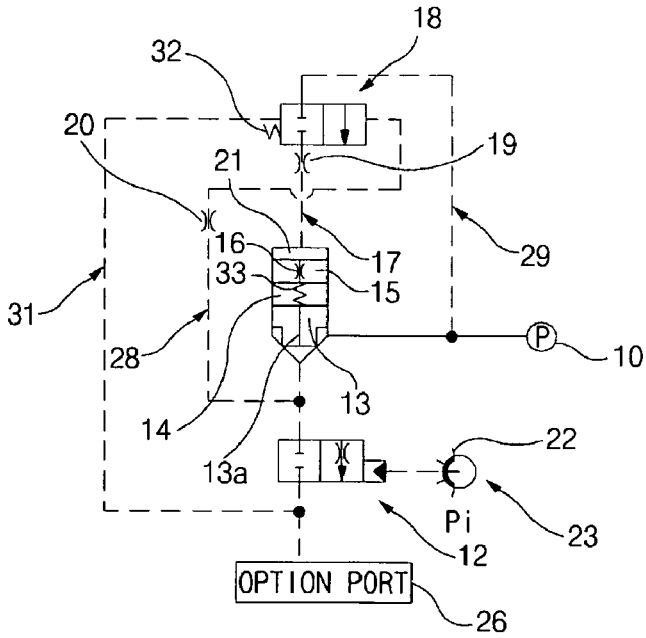
FIG. 6 is a circuit diagram illustrating a hydraulic circuit according to another embodiment of the present invention.

As shown in FIG. 6, if diverse option devices having different operation pressures are used as means for applying a pilot signal pressure to shift the first spool 12, the hydraulic circuit for an option device of heavy construction equipment according to another embodiment of the present invention further includes an electric selection switch 23 for supplying a pilot signal pressure to a flow rate display unit 22 that is required for the selected option device 11, corresponding to the flow rate applied to the selected option device 11.

The construction as shown in FIG. 6 is substantially equal to that as shown in FIG. 2, except for the electric selection switch 23 having a multilevel flow rate display 22 for applying the pilot signal pressure corresponding to the hydraulic fluid required for the selected option device 11 to the first spool 12. Therefore, its detailed construction is not described herein, and the like components are indicated by the same reference numerals.

Figure 7:
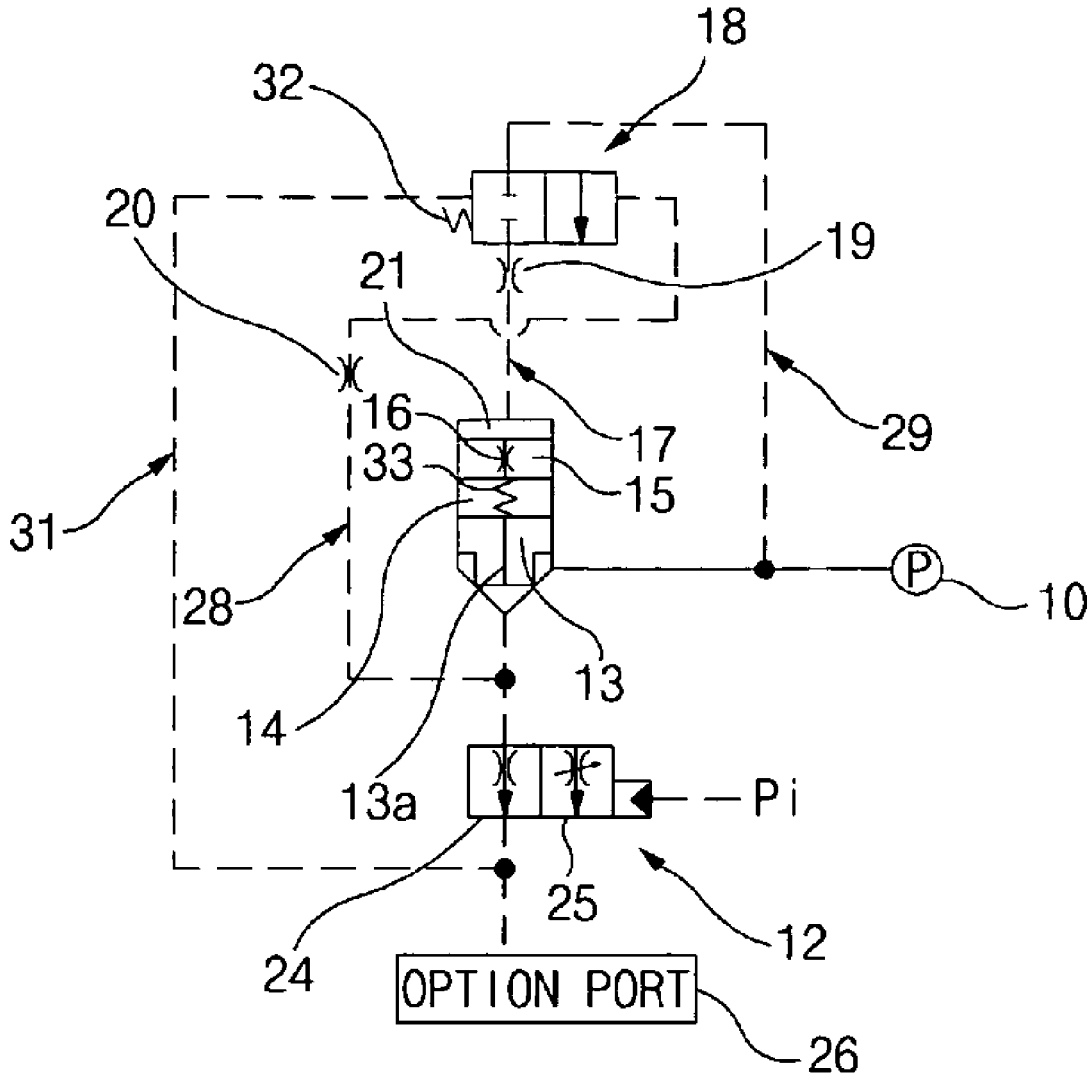
FIG. 7 is a diagram illustrating a hydraulic circuit according to still another embodiment of the present invention.

As shown in FIG. 7, the hydraulic circuit for an option device of heavy construction equipment according to another embodiment of the present invention includes a stationary orifice 24, installed in a flow path between the hydraulic pump 10 and the option device 11, for controlling the hydraulic fluid supplied from the hydraulic pump 10 to the option device 11, and a variable orifice 25 for being switched on/off in response to the pilot signal pressure applied from the outside to variably control the hydraulic fluid supplied from the hydraulic pump 10 to the option device 11.

The construction as shown in FIG. 7 is substantially equal to that as shown in FIG. 2, except for the stationary orifice 24 for controlling the hydraulic fluid supplied from the hydraulic pump 10 to the option device 11, and the variable orifice 25 for being switched on/off in response to the pilot signal pressure applied from the exterior to variably control the hydraulic fluid supplied to the option device 11. Therefore, its detailed construction is not described herein, and the like components are indicated by the same reference numerals.

As described above, the hydraulic circuit for the option device of the heavy construction equipment according to the present invention has the following advantages.

Since the flow rate discharged from the hydraulic pump is constantly supplied to the option device regardless of the load produced on the option device such as a breaker, the operation speed of the option device becomes constant. Also, since the flow rate to be supplied is optionally controlled in the case where the option device has a different specification, the operation efficiency can be increased.

In addition, since even unskilled driver can easily manipulate various kinds of option devices, the driver is provided with easiness of manipulation.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A hydraulic circuit for an option device of heavy construction equipment, comprising:

a variable displacement hydraulic pump;

an option device connected to the hydraulic pump;

a first spool, installed in a flow path between the hydraulic pump and the option device, for being shifted in response to a pilot signal pressure applied from an outside to control a flow rate applied from the hydraulic pump to the option device;

a poppet, operatively installed in a flow path between the hydraulic pump and the first spool, for supplying hydraulic fluid from the hydraulic pump to the option device when the first spool is shifted, and a piston resiliently urged in a back pressure chamber of the poppet;

a second spool for being shifted by a pressure difference between pressures of the hydraulic fluid before and after the hydraulic fluid passes through the first spool, and controlling the flow rate applied from the hydraulic pump to the back pressure chamber of the poppet via a through-path communicating with the back pressure chamber when the second spool is shifted;

a first orifice, formed on the piston, for controlling the hydraulic fluid discharged from the hydraulic pump and supplied to the back pressure chamber of the poppet when the second spool is shifted;

a second orifice, installed in a flow path between the second spool and the back pressure chamber of the piston, for controlling the hydraulic fluid supplied from the hydraulic pump to the back pressure chamber of the piston when the second spool is shifted; and a third orifice, having an inlet that communicates with a flow path between the first spool and the poppet and an outlet installed in a path that communicates with the second spool, for controlling the hydraulic fluid that is discharged from the hydraulic pump and shifts the second spool, wherein if the hydraulic fluid is supplied from the hydraulic pump to the option device, a pressure loss produced between signal pressures that shift the second spool is maintained constant by a repeated shifting of the second spool to control the hydraulic fluid to be constantly supplied to the option device.

2. The hydraulic circuit as claimed in claim 1, further comprising an electric selection switch for applying the pilot signal pressure to a flow rate display unit required for the option device, corresponding to the flow rate being supplied to the option device, if diverse option devices are used as means for applying the pilot signal pressure to shift the first spool.

3. A hydraulic circuit for an option device of heavy construction equipment, comprising:

a variable displacement hydraulic pump;

an option device connected to the hydraulic pump;

a first spool having an orifice, installed in a flow path between the hydraulic pump and the option device, for controlling hydraulic fluid to be discharged from the hydraulic pump and supplied to the option device, and a variable orifice for being shifted in response to a pilot signal pressure applied from an outside to variably control the hydraulic fluid supplied from the hydraulic pump to the option device;

a poppet, operatively installed in a flow path between the hydraulic pump and the first spool, for supplying the hydraulic fluid from the hydraulic pump to the option device from the hydraulic pump when the first spool is shifted, and a piston resiliently urged in a back pressure chamber of the poppet;

a second spool for being shifted by a pressure difference between pressures of the hydraulic fluid before and after the hydraulic fluid passes through the first spool, and controlling the flow rate applied from the hydraulic pump to the back pressure chamber of the poppet via a through-path communicating with the back pressure chamber when the second spool is shifted;

a first orifice, formed on the piston, for controlling the hydraulic fluid discharged from the hydraulic pump and supplied to the back pressure chamber of the poppet when the second spool is shifted;

a second orifice, installed in a flow path between the second spool and the back pressure chamber of the piston, for controlling the hydraulic fluid supplied from the hydraulic pump to the back pressure chamber of the piston when the second spool is shifted; and a third orifice, having an inlet that communicates with a flow path between the first spool and the poppet and an outlet installed in a path that communicates with the second spool, for controlling the hydraulic fluid that is discharged from the hydraulic pump and shifts the second spool, wherein if the hydraulic fluid is supplied from the hydraulic pump to the option device, a pressure loss produced between signal pressures that shift the second spool is maintained constant by a repeated shifting of the second spool to control the hydraulic fluid to be constantly supplied to the option device.

4. The hydraulic circuit as claimed in claim 3, further comprising an electric selection switch for applying the pilot signal pressure to a flow rate display unit required for the option device, corresponding to the flow rate being supplied to the option device, if diverse option devices are used as means for applying the pilot signal pressure to shift the first spool.

* * * * *